United States Patent [19]

Hartwig

[11] 4,024,366

[45] May 17, 1977

[54] TOGGLE LEVER SWITCHING MECHANISM FOR AN AUTOMATIC SWITCHING APPARATUS INCLUDING A LOW-VOLTAGE TRIPPING DEVICE

[75] Inventor: Gerhard Hartwig, Rosenheim, Germany

[73] Assignee: Siemens Aktiengesellschaft, Munich, Germany

[22] Filed: Apr. 5, 1976

[21] Appl. No.: 673,384

[30] Foreign Application Priority Data

Apr. 23, 1975 Germany ..... 2518093

[52] U.S. Cl. ..... 200/153 G

[51] Int. Cl.[2] ..... H01H 5/06

[58] Field of Search ..... 200/153 G; 335/46, 38, 335/21

[56] References Cited

UNITED STATES PATENTS

| | | | |
|---|---|---|---|
| 2,862,075 | 11/1958 | Netzel | 200/153 G |
| 3,003,046 | 10/1961 | Torre | 200/153 G |
| 3,621,189 | 11/1971 | Link et al. | 200/153 G |

*Primary Examiner*—Herman Hohauser

*Attorney, Agent, or Firm*—Kenyon & Kenyon Reilly Carr & Chapin

[57] ABSTRACT

A toggle lever switching mechanism for an automatic switching apparatus including a housing and a low-voltage tripping device. The switching mechanism includes at least two toggle levers pivotally joined to each other at one end at a toggle joint and operatively connected to an actuating member for the switching mechanism by means of a spring member. The other ends of the toggle levers are pivotally coupled to a movable contact member of the switching apparatus and to a support lever which engages a latching pawl of the switching mechanism. The improvement of the invention comprises a support lever which is pivotally mounted in the switching mechanism housing at one end thereof and is pivotally coupled to one of the toggle levers at a point intermediate the ends thereof. Stop means are disposed in the switching mechanism housing for engaging and limiting the movement of the support lever so as to prevent the support lever from engaging the latching pawl during initial movement of the actuating member from a contact-open position to a contact-closed position of the switching apparatus.

4 Claims, 4 Drawing Figures

TOGGLE LEVER SWITCHING MECHANISM FOR AN AUTOMATIC SWITCHING APPARATUS INCLUDING A LOW-VOLTAGE TRIPPING DEVICE

BACKGROUND OF THE INVENTION

1. Field of the Invention

The present invention relates generally to automatic switching apparatus, and in particular, to an improved toggle lever switching mechanism for an automatic switching apparatus including a low-voltage (under-voltage) tripping device.

2. Description of the Prior Art

Toggle lever switching mechanisms for automatic switching apparatus including a low-voltage tripping device are generally known in the art. In one known switch of the above-described type, described in detail in German Auslegeschrift 1,293,309, the switching mechanism collapses during closing of the switch as soon as the latch pawl of the mechanism is affected by the tripping device of the apparatus. In other words, the support lever of the switching mechanism is disposed in engagement with the latching pawl of the apparatus at the start of the closing of the automatic switch. As a result, it is impossible to couple such a switch with a network monitored by a low-voltage tripping device without providing a separate switching device externally of the automatic switch for setting the low voltage of the tripping device.

SUMMARY OF THE INVENTION

It is therefore an object of the present invention to provide an improve toggle lever switching mechanism for an automatic switching apparatus which overcomes the aforementioned disadvantages of heretofore known toggle lever switching mechanisms and enables the latching of a main switch of such a switching apparatus with a low-voltage tripping device.

These and other objects of the invention are achieved in a toggle lever switching mechanism for an automatic switching apparatus including a housing and a low-voltage tripping device. The switching mechanism includes at least two toggle levers pivotally joined to each other at one end thereof at a toggle joint and operatively connected to an actuating member for the switching mechanism by means of a spring member coupled at one end to the actuating member and at the other end to the toggle lever joint. The other ends of the toggle levers are pivotally coupled to a movable electrical contact member of the switching apparatus and to a support lever which engages a latching pawl of the switching mechanism. The improvement of the invention comprises a support lever pivotally mounted in the switching mechanism housing at one end thereof and pivotally coupled to one of the toggle levers at a point intermediate the aforesaid one end and the other end of the support lever. Stop means are disposed in the switching mechanism housing for engaging and limiting the movement of the support lever so as to prevent the lever from engaging the latching pawl during initial movement of the actuating member from a contact-open position to a contact-closed position of the switching apparatus.

By "latching" of a main switch to a low-voltage tripping device of a switching apparatus is meant a so-called "voltage-free null-contact" latching of a main switch wherein closing of the main switch can be achieved only if all following branch switches are in their "off" positions. In order to achieve this, the branch switches must be equipped with auxiliary break contacts, the so-called "null contacts", through which the low-voltage tripping device of the main switch is wired. A voltage-free null-contact latching also requires that no voltage be present at the null contacts of the branch switches if the main switch is switched off. A simple latching of the main switch with a low-voltage tripping device is achieved by the toggle lever switching mechanism described above by associating the support lever for the toggle joint with the actuating member of the switching mechanism in such a manner that the support lever is prevented from resting against the latching pawl of the mechanism during initial movement of the actuating member to the contact-closed position of the apparatus.

It is also conceivable to provide the actuating member of the switching mechanism with a lead for switching on a keying device. This would, however, significantly increase the operating travel distance of the actuating member if the appropriate tolerances are to be maintained. Thus, in one embodiment of the invention, the support lever comprises a step-up lever which, as stated previously herein, is pivotally mounted in the housing at one end thereof, and includes a projection member which engages the actuating member and pivots the support member. With such an arrangement, the point of engagement of the support part of the toggle joint can be freely chosen without regard to tolerances for travel distance changes of the actuating member of the mechanism. Satisfactory results have been obtained by using a support lever with a leverage ratio of 1:3.

The switch utilized for switching on the low-voltage tripping device of the apparatus can be disposed at any contact shaft but in view of the tolerances which must be maintained it is advantageous if the keying device is actuated by the actuating member during the latter's initial operational movement and is also associated with the actuating member of the switching mechanism.

These and other features of the invention will be described in greater detail in the following detailed description.

BRIEF DESCRIPTION OF THE DRAWINGS

In the drawings, wherein similar reference numerals denote similar elements throughout the several views thereof.

DETAILED DESCRIPTION

Figure 1:
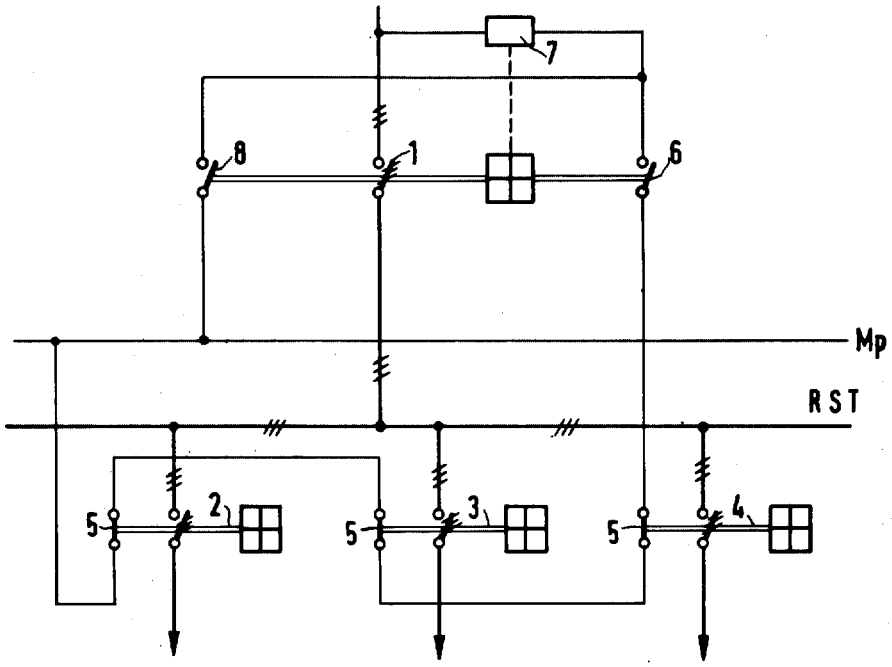
FIG. 1 is a schematic diagram of a voltage-free null-contact latching system for an automatic switching apparatus including a low-voltage tripping device.

Referring now to the drawings, and in particular to FIG. 1, there is shown a schematic circuit diagram of an automatic switching apparatus including a main switch 1 and a plurality of branch switches 2, 3 and 4 which are coupled to a three-phase electrical power line RST. Each of the branch switches are equipped with break contacts 5, which comprise auxiliary switches, and are coupled in series relationship with an auxiliary make contact 6 of main switch 1 and apply voltage to a low-voltage tripping device 7 coupled to main switch 1. In order to prevent the main switch from opening again when a branch switch is closed because a voltage is not applied to low-voltage tripping device 7, a normal auxiliary contact 8 is provided for applying a voltage to tripping device 7 after main switch 1 is closed. As can be seen from the diagram, auxiliary switch 6 must be closed before main switch 1 is closed in order to apply a voltage to the tripping device. The operation of this switch will now be described in further detail with reference to FIGS. 2 through 4 which illustrate the mechanical design of the switch.

The toggle lever switching mechanism of the switching apparatus comprises a pair of toggle levers 9 and 10 and a dead-center spring 13 which is fastened, e.g., hooked into, the actuating member or toggle arm 11 of the switch at the point 12. The other end of spring 13 is coupled to a toggle joint 14 at which toggle levers 9 and 10 are pivotally connected to each other. Toggle lever 9 is connected by means of a joint pin 15 with a switching shaft 17 on which a movable electrical contact is mounted. Toggle lever 10 is braced by means of a joint pin 18 against a support lever 19 which is pivotally mounted in the switching mechanism housing by means of pin 20. The support lever includes a free end 21 which cooperates with a pivotal intermediate pawl 22 which engages a latching pawl 23. Pawl 23 is operable by means of a tripping device (not shown), more specifically, a low-voltage (undervoltage) tripping device.

Figure 2:
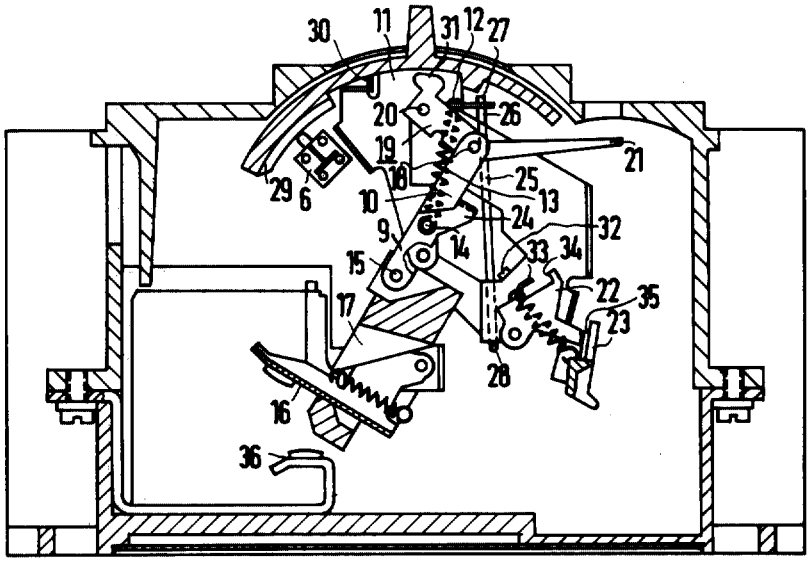
FIG. 2 is a cross-sectional view of an improved toggle lever switching mechanism constructed according to the invention, showing the switching mechanism in its "tripped" position.
Figure 3:
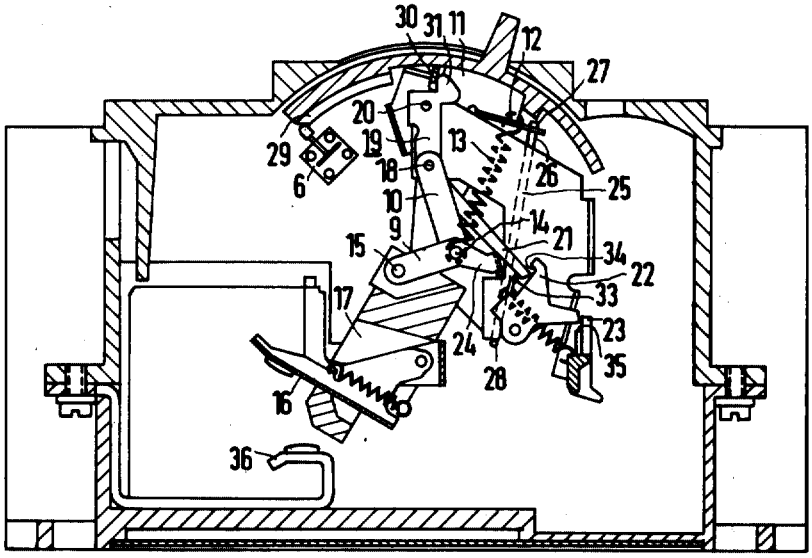
FIG. 3 is another cross-sectional view of the switching mechanism illustrated in FIG. 2, showing the switch in its "off" position.
Figure 4:
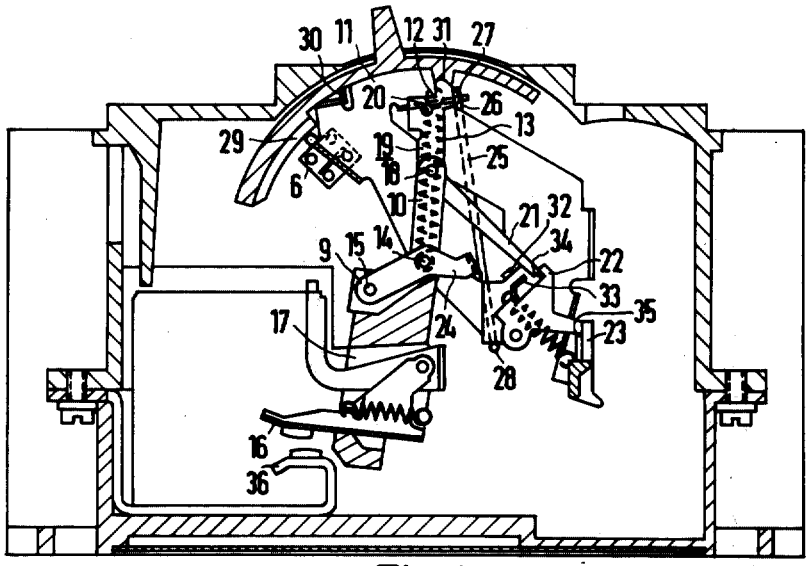
FIG. 4 is a further cross-sectional view of the switching mechanism illustrated in FIG. 2, showing the mechanism in a position shortly prior to switching on of the switch.

When the switching apparatus is closed, an extension member 24 of the toggle lever 9 can be engaged with a staying element 25 which, in the embodiment of the invention illustrated, comprises a U-shaped bracket. The staying element is inserted with its ends 26 disposed through openings 27 in the actuating member 11, and has the other end 28 thereof hinged at the wall of the housing of the switching mechanism. Switch 6 is also fastened to the wall of the switching mechanism housing and cooperates with a boss member 29 of actuating member 11. FIG. 3 illustrates the intermediate position of switch 6 in which the break contact is open but the make contact is not yet closed. FIGS. 2 and 4 show the make contact of the switch in its closed position.

In FIG. 2, the switch is shown in its tripped position after the occurrence of, for example, an overcurrent, a short circuit or a voltage failure. After the switch has been tripped, the actuating member 11 must first be pushed a further distance in a direction towards the off position of the switch, as shown in FIG. 3. During this movement of the actuating member, the support lever 19 is moved in a clockwise direction by a projection member 31 provided at the end thereof which engages the actuating member at point 30. During movement of the support lever, bearing pin 18 is moved in a direction towards the connecting line between the toggle joint 14 and pin 20. When the bearing pin 18 crosses this connecting line, the pin drops through under the force exerted by spring 13 and, as a result of the configuration of the forces, without any further force exerted at the toggle arms, until the free end 31 of support lever 19 engages the stop member 32 of the mechanism housing. In the course of this movement, the latching point is cocked by means of a tab 33 provided on intermediate pawl 22. At the completion of the lever movement, the switch is ready to be closed again.

As can be seen from the drawings, the arrangement of the toggle switching mechanism components and the pivot points thereof are chosen so that in the off position of the switch, in which the switch is ready to be closed, the free end 21 of support lever 19 does not engage or rest against the latching point 34 but rather engages and rests against the stop member 32. As a result, the latching 35 between the intermediate pawl 22 and the latch pawl 23 is not established. Only during the closing of the switch, and immediately prior to the position of the switch reached in FIG. 4, do the aforesaid components engage each other so that switch 6 can be operated. When the toggle lever switching mechanism is switched on, toggle lever 9 is engaged at extension member 24 by the staying element 25 and is pushed in a counterclockwise direction, to the left in the drawings. Thus, toggle levers 9 and 10 are slowly brought into their extended position and movable contact 16 of the switching apparatus is brought within a few millimeters of fixed contact 36 of the switch. At this particular point, the spring member suspension point 12 forms a straight connecting line with the two bearing points of the toggle arms, namely, toggle joint 14 and bearing pin 18, as illustrated in FIG. 4. Upon further closing of the switch, the dead-center position of spring 13 is passed and the toggle arms are brought into a final extended position and the contacts of the switch are closed without bouncing. During the transition from the position of the toggle lever switching mechanism shown in FIG. 3 to the position shown in FIG. 4, switch 6 is closed and voltage is applied by switch 6 to the low-voltage tripping device before either of the latching points 34 or 35, respectively, is loaded. Otherwise, the latch would collapse and closing of the switch would not be possible.

By constructing the toggle lever switching mechanism as described herein, not only can voltage be applied to the low-voltage tripping device of the switching apparatus, but, in addition, contact bounce of the switching apparatus contacts during closing can be reduced.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and the drawings are, accordingly, to be regarded in an illustrative rather than in a restrictive sense.

What is claimed is:

1. In a toggle lever switching mechanism for an automatic switching apparatus including a housing and a low-voltage tripping device, said toggle lever switching mechanism including at least two toggle levers pivotally joined to each other at one end thereof at a toggle joint and operatively connected to an actuating member for said switching mechanism by means of a spring member coupled at one end to said actuating member and at the other end to said toggle joint, the other ends of said toggle levers being pivotally coupled to a movable electrical contact member of said switching apparatus and to a support lever which engages a latching pawl of said switching mechanism, the improvement comprising:

a support lever, pivotally mounted in said housing at one end thereof and pivotally coupled to one of said toggle levers at a point intermediate said one end and the other end of said support lever, and stop means, disposed in said switching mechanism housing, for engaging and limiting the movement of said support lever so as to prevent said support lever from engaging said latching pawl during initial movement of said actuating member from a contact-open position to a contact-closed position of said switching apparatus.

2. The toggle lever switching mechanism recited in claim 1, wherein said support lever comprises a step-up lever and includes a projection member at said one end thereof pivotally mounted in said housing for engaging said actuating member and pivoting said support member.

3. The toggle lever switching mechanism recited in claim 2, wherein said step-up lever provides a leverage step-up ratio of 1:3.

4. The toggle lever switching mechanism recited in claim 1, further comprising keying switch means mounted in said switching mechanism housing and operatively engagable by said actuating member during said initial movement of said actuating member from said contact-open position to said contact-closed position of said switching apparatus.

* * * * *